US011180929B2

(12) United States Patent
Walsh

(10) Patent No.: US 11,180,929 B2
(45) Date of Patent: Nov. 23, 2021

(54) LOW TEMPERATURE CONTROL OF LOCK ACTUATOR

(71) Applicant: SARGENT MANUFACTURING COMPANY, New Haven, CT (US)

(72) Inventor: John Walsh, Wallingford, CT (US)

(73) Assignee: Sargent Manufacturing Company, New Haven, CT (US)

( * ) Notice: Subject to any disclaimer, the term of this patent is extended or adjusted under 35 U.S.C. 154(b) by 635 days.

(21) Appl. No.: 16/128,723

(22) Filed: Sep. 12, 2018

(65) Prior Publication Data

US 2019/0085596 A1 Mar. 21, 2019

Related U.S. Application Data

(60) Provisional application No. 62/560,327, filed on Sep. 19, 2017.

(51) Int. Cl.
*E05B 47/00* (2006.01)
*E05B 47/02* (2006.01)
*E05B 63/00* (2006.01)

(52) U.S. Cl.
CPC ..... *E05B 47/0001* (2013.01); *E05B 47/026* (2013.01); *E05B 47/0012* (2013.01);
(Continued)

(58) Field of Classification Search
CPC .. E05B 47/0012; E05B 47/0001; E05B 47/00; E05B 2047/0073; E05B 17/22; E05B 63/0065; E05B 2047/0048; E05B 47/026; E05B 2047/0057; E05B 2047/0072; E05B 2063/0091; Y10T 292/1021; Y10T 70/625; Y10T 70/70; Y10T 70/7062; G07C 9/00174; G07C 2009/00634; E05F 15/71
See application file for complete search history.

(56) References Cited

U.S. PATENT DOCUMENTS 2,774,855 A * 12/1956 Simmons ..... E05B 17/0016 70/492
4,593,543 A * 6/1986 Stefanek ..... E05B 47/0002 292/144

(Continued)

*Primary Examiner* — Mark A Williams
(74) *Attorney, Agent, or Firm* — DeLio Peterson & Curcio LLC; Peter W. Peterson; Brian G. Schlosser

(57) ABSTRACT

A lock includes an electrically powered locking mechanism operable between locked and unlocked positions, a power supply, and a controller for operating the locking mechanism between locked and unlocked positions. The controller regulates the amount of electric power supplied to the electrically powered locking mechanism and determines temperature in the vicinity of the locking mechanism, and is capable of supplying first and second levels of electric power to the electrically powered locking mechanism in accordance with the temperature in the vicinity of the locking mechanism. If the temperature in the vicinity of the locking mechanism is within a predetermined temperature range, a first level of electric power is supplied to the electrically powered locking mechanism to operate between locked and unlocked positions. If the temperature is below the predetermined temperature range, a second, lower level of electric power is supplied to the electrically powered locking mechanism.

19 Claims, 2 Drawing Sheets

(52) U.S. Cl.
CPC ..... *E05B 2047/0057* (2013.01); *E05B 2047/0072* (2013.01); *E05B 2063/0091* (2013.01)

(56) References Cited

U.S. PATENT DOCUMENTS

| | | | | |
|---|---|---|---|---|
| 2004/0045330 | A1* | 3/2004 | Moon | E05B 47/0673 70/107 |
| 2005/0207087 | A1* | 9/2005 | Fisher | G07C 9/0069 361/160 |
| 2005/0284200 | A1* | 12/2005 | Moon | G07C 9/00817 70/278.2 |
| 2011/0203331 | A1* | 8/2011 | Picard | E05B 47/0046 70/91 |
| 2014/0202220 | A1* | 7/2014 | Denison | E05B 65/0811 70/267 |
| 2016/0145904 | A1* | 5/2016 | Lowder | E05B 47/00 340/542 |
| 2017/0260775 | A1* | 9/2017 | Denison | E05B 47/0603 |
| 2018/0340351 | A1* | 11/2018 | Harkonen | G01R 31/64 |

* cited by examiner

LOW TEMPERATURE CONTROL OF LOCK ACTUATOR

BACKGROUND OF THE INVENTION

1. Field of the Invention

This invention relates to locks and to control of locks and lock actuators for locking mechanisms, particularly at lower temperatures.

2. Description of Related Art

Powered locking mechanism exposed to the outdoors need to perform properly at different temperatures. It has been found that at temperatures well below that of normal ambient, room temperature range, i.e., about 65°-75°, performance of electrical locking motors in locks can become sluggish due to thickening viscosity of lubricants, e.g., grease, or by additional friction, for example, that result from the reduction of clearances due to the effects of coefficients of thermal expansion.

SUMMARY OF THE INVENTION

Bearing in mind the problems and deficiencies of the prior art, it is therefore an object of the present invention to provide an improved lock that is able to function at varying temperatures.

It is another object of the present invention to provide a locking mechanism that is driven to overcome performance issues due to temperature change, particularly at temperatures well below ambient, such as sub-freezing temperatures.

A further object of the invention is to provide a method and system for controlling the operation of lock actuators and the power applied thereby to locking mechanisms, at a variety of temperatures.

Still other objects and advantages of the invention will in part be obvious and will in part be apparent from the specification.

The above and other objects, which will be apparent to those skilled in the art, are achieved in the present invention which is directed to a method of ensuring performance of a powered locking mechanism at different temperatures. The method comprises providing a lock having an electrically powered locking mechanism operable between locked and unlocked positions, providing an electric power supply for the locking mechanism, and providing a controller for operating the locking mechanism between locked and unlocked positions. The controller is capable of regulating the amount of electric power supplied to the electrically powered locking mechanism in accordance with a determined temperature in the vicinity of the locking mechanism. The method then includes determining temperature in the vicinity of the locking mechanism. If the temperature in the vicinity of the locking mechanism is within a predetermined temperature range, the method includes causing, by the controller, a first level of electric power to be supplied to the electrically powered locking mechanism to operate between locked and unlocked positions. If the temperature in the vicinity of the locking mechanism is outside the predetermined temperature range, the method includes causing, by the controller, a second level of electric power to be supplied to the electrically powered locking mechanism to operate between locked and unlocked positions, the second level of electric power being different than the first level of electric power.

If the temperature in the vicinity of the locking mechanism is below the predetermined temperature range, the controller may cause the second level of electric power to be supplied to the electrically powered locking mechanism to operate between locked and unlocked positions, wherein the second level of electric power is greater than the first level of electric power.

The first level of electric power may be supplied to the electrically powered locking mechanism at room temperatures, and the second level of electric power may be supplied to the electrically powered locking mechanism at sub-freezing temperatures.

The electrically powered locking mechanism may project and retract a latch- or deadbolt between locked and unlocked positions, or may move a locking piece in and out of locking engagement with a lock hub. The locking mechanism may be powered between locked and unlocked positions by an electric motor, or by a solenoid. The electric power may be supplied to the locking mechanism in the form of an electrical pulse, or in the form of continuous electrical power. The second level of electric power may be a different current than the current of the first level of electric power, may be a different voltage than the voltage of the first level of electric power or may be a different pulse length than the pulse length of the first level of electric power.

The second level of electric power may be varied above the first level of electric power by an amount depending on the temperature in the vicinity of the locking mechanism.

The method may further include providing a temperature sensor for determining the temperature in the vicinity of the locking mechanism, or calculating the temperature in the vicinity of the locking mechanism by measuring electrical resistance of a conductor in the lock mechanism.

In a related aspect, the present invention provides a lock comprising an electrically powered locking mechanism operable between locked and unlocked positions, an electric power supply for the locking mechanism, and a controller for operating the locking mechanism between locked and unlocked positions. The controller is capable of regulating the amount of electric power supplied to the electrically powered locking mechanism and determining temperature in the vicinity of the locking mechanism, the controller being capable of supplying first and second levels of electric power to the electrically powered locking mechanism in accordance with the temperature in the vicinity of the locking mechanism.

If the temperature in the vicinity of the locking mechanism is within a predetermined temperature range, the controller is capable of causing a first level of electric power to be supplied to the electrically powered locking mechanism to operate between locked and unlocked positions. If the temperature in the vicinity of the locking mechanism is below the predetermined temperature range, the controller is capable of causing the second level of electric power to be supplied to the electrically powered locking mechanism to operate between locked and unlocked positions, the second level of electric power being greater than the first level of electric power.

The electrically powered locking mechanism may be a latchbolt, a deadbolt, a locking piece, or linkage associated therewith. The lock may further include a temperature sensor for determining the temperature in the vicinity of the locking mechanism. The controller may be capable of calculating the temperature in the vicinity of the locking mechanism by measuring electrical resistance of a conductor in the lock mechanism.

The controller may be capable of varying the second level of electric power above the first level of electric power depending on the temperature in the vicinity of the locking mechanism.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the embodiment of the present invention, reference will be made herein to FIGS. 1-5 of the drawings in which like numerals refer to like features of the invention.

The present invention is directed to a method and apparatus for ensuring performance of a powered locking mechanism at different temperatures, particularly at temperatures well below that of normal ambient, room temperature, i.e., about 65°-75°, where performance of electrical locking motors in locks can become sluggish due to thickening viscosity of lubricants, e.g., grease, or by additional friction. For example, additional friction may result from the reduction of clearances due to the effects of coefficients of thermal expansion. Embodiments of the method and apparatus of the present invention that provide improved locking mechanisms at different temperatures, particularly lower temperatures, are described below.

An otherwise conventional swinging door or other portal may have a lock that includes one or more locking mechanisms operable between locked and unlocked positions. The lock may be any otherwise conventional mortise, tubular or cylindrical lock, such as those typically located at the mid-point of the side edge of the door, a vertical lock with upper and/or lower locking mechanisms or any other type of lock. The locking mechanisms may be, for example, a latch- or deadbolt that projects or extends into a strike in the door frame to lock the door, and retracts from the strike to unlock the door. The locking mechanism may also be a locking piece that moves in and out of locking engagement with a lock hub to prevent the lock handle from rotating (and fix the latchbolt in a position) or permit the handle to rotate (and the latchbolt to move), respectively. The locking mechanism may further be a linkage or other moving component such as a spring or one or more gears that connects to or drives a locking bolt or piece. Conventional lubricants may be employed, e.g., grease or oil, to lubricate the movement of the bolt, linkage, locking piece and other moving components.

Figure 1:
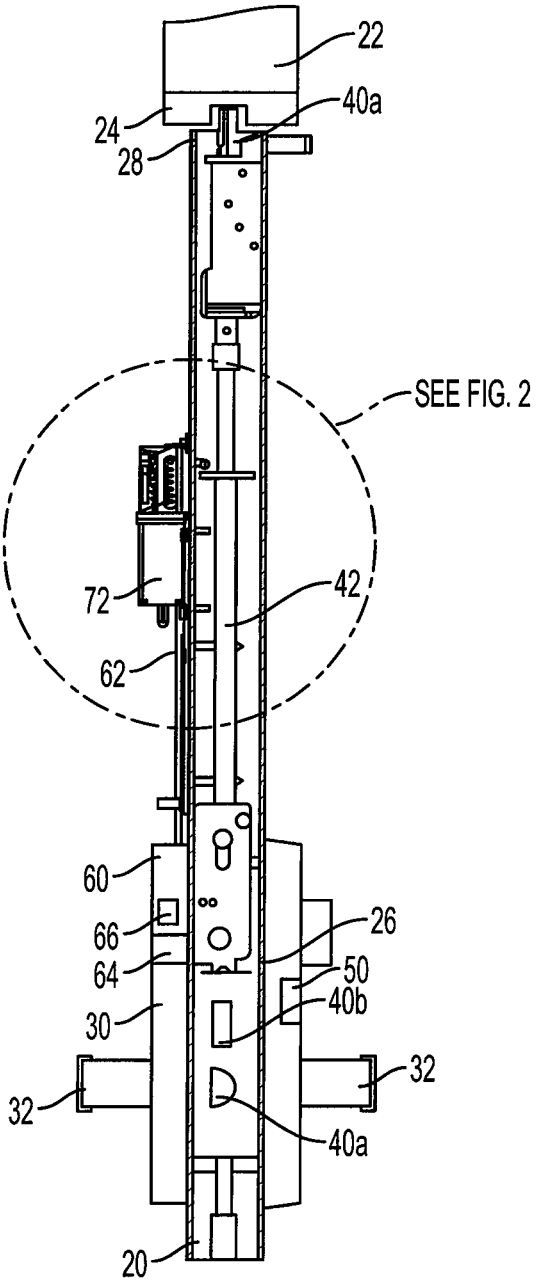
FIG. 1 is a side elevational view of an embodiment of a multi-point lock and locking mechanism, including a motor-driven vertical latchbolt controlled in accordance with the present invention.
Figure 2:
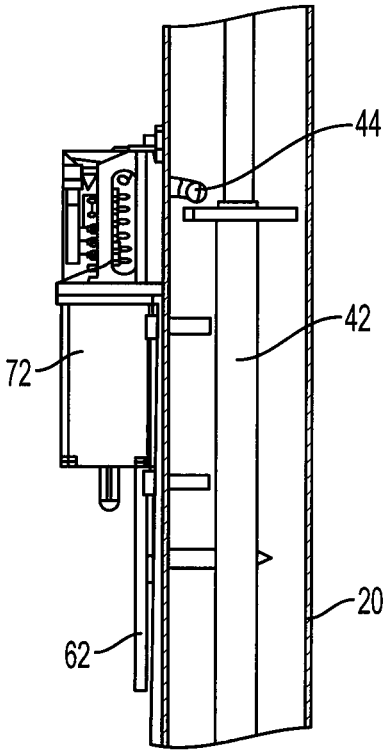
FIG. 2 is a close-up side view of the motor actuator for the vertical latchbolt of FIG. 1.

As shown in FIGS. 1 and 2, door 20 has a lock 30 that operates, via lever handles 32, otherwise conventional locking mechanisms comprising a latchbolt 40*a* and deadbolt 40*b* at the mid-point of the door side edge 26, and a vertical latchbolt 40*a*, connected to the lock by linkage 42, that projects from door upper edge 28 into strike 24 in door frame 22. Lock 30 includes motor actuator 72 that drives lever 44 upward or downward, which in turn moves linkage 42 connected to vertical latchbolt 40*a* in and out of strike 24.

Figure 3:
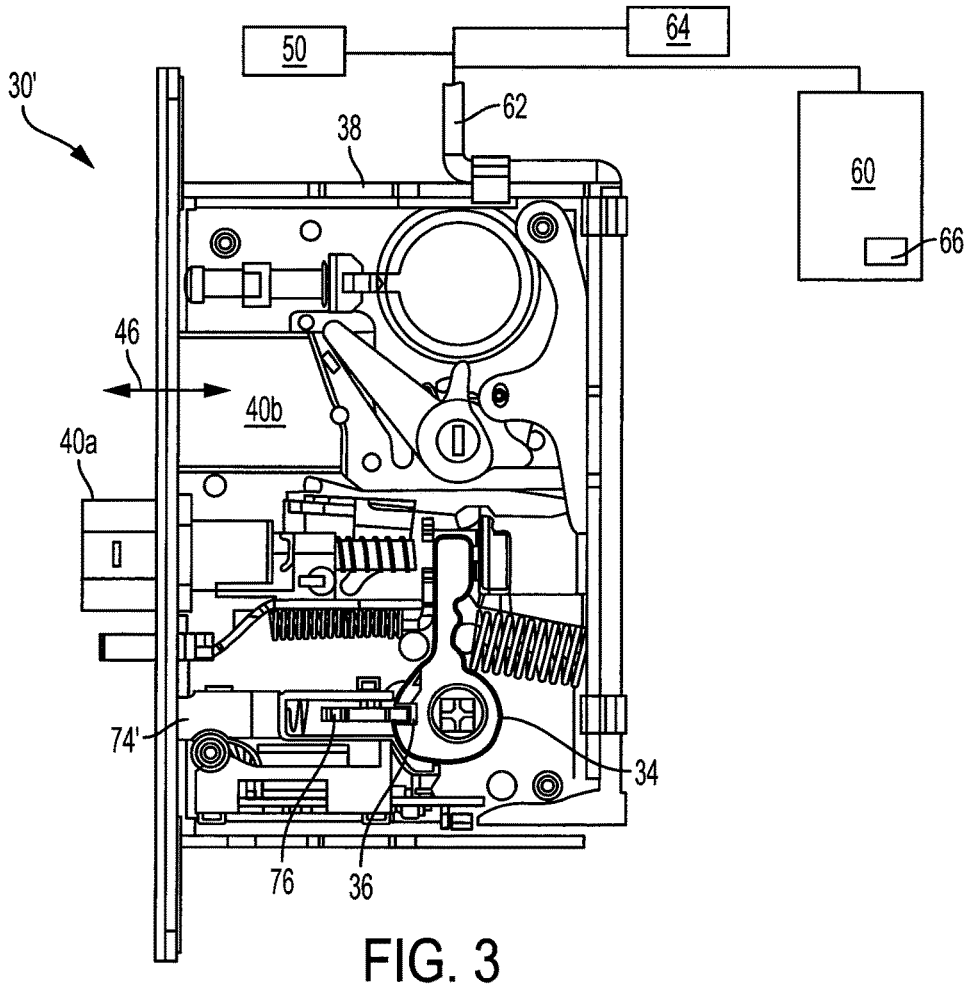
FIG. 3 is a side elevational view of an embodiment of a mortise lock and locking mechanisms, including a motor-driven deadbolt and a motor-drive hub locking piece controlled in accordance with the present invention.
Figure 4:
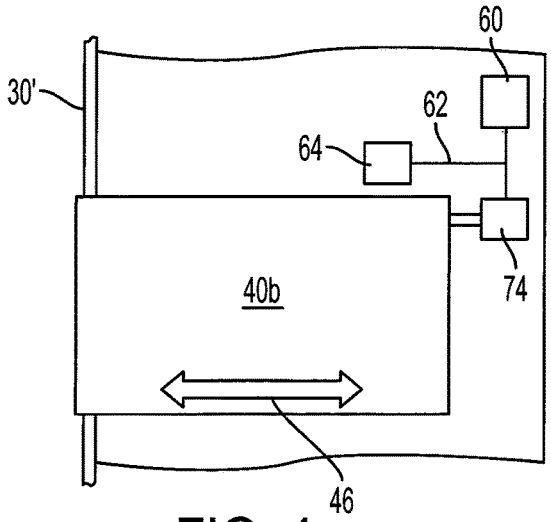
FIG. 4 is a close-up side view of the motor actuator and the deadbolt of FIG. 3 in the retracted position.
Figure 5:
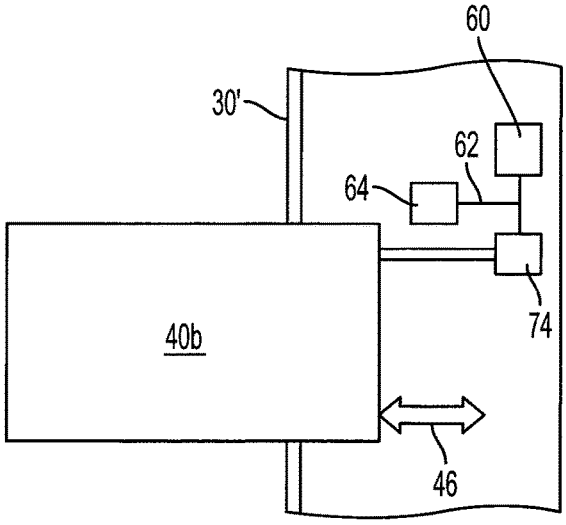
FIG. 5 is a close-up side view of the motor actuator and the deadbolt of FIG. 3 in the extended position.

In FIGS. 3-5, a mortise lock 30' having within housing 38 operable locking mechanisms comprising a latchbolt 40*a* and deadbolt 40*b* extendible from a side thereof. Mortise lock 30' may include motor 74 (which may include one or more linkages, gears and/or other moving components) that drives deadbolt 40*b* to translate in opposing directions 46 between a retracted position (FIG. 4) and an extended position (FIG. 5). Mortise lock 30' is also shown to include a locking mechanism comprising a locking piece 76, which is translated by motor 74' connected via a screw and spring, to move in and out of locking engagement with a slot 36 in spindle hub 34 (to which the lock handles are attached) to prevent the handle from rotating or permit the handle to rotate, respectively. A solenoid in lock 30' may be also used to drive latchbolt 40*a* or deadbolt 40*b*.

The locking mechanism, e.g., the latch- or deadbolt, locking piece, linkage, gear, screw, spring or other moving component, may be powered or driven by any electrical actuator, such as a motor, including a stepper motor, a solenoid, a linear driver, or other electrical actuator that operates electrically and allows the lock to be remotely locked or unlocked. A motor actuator typically employs a drive motor that may alternately move in two directions, i.e., in one direction to lock the locking mechanism and in the other direction to unlock the locking mechanism.

In both embodiments shown, an electric power supply 64 provides power to the motor or solenoid for the locking mechanism to drive it between locked and unlocked positions. This power supply 64 may be by battery power located in or on the door 20 or door frame 22, or in the vicinity thereof, or by cable from the local electrical wiring.

In accordance with the present invention, a controller 60 is provided for operating the locking mechanism between locked and unlocked positions, and a temperature sensor 50 may be provided for determining the temperature in the vicinity of the locking mechanism. Alternatively, where an electrical conductor such as a coil based actuator is employed in the lock, e.g., a solenoid, the temperature may be determined by controller 60 by the Change of Resistance (COR) method, such as by UL1034 Standard Section 41.5, where the resistance of the electrically conductive winding at the temperature to be determined is compared with the resistance at a known temperature, and the temperature at the winding is calculated. This removes the need for a discrete temperature sensor.

The controller 60 and/or temperature sensor 50 may be located on the lock 20, the lock 30, on the door 20 itself, or even remote from the door. The controller 60 is operatively connected to and in communication with the temperature sensor, or is programmed to determine temperature by the COR method. In addition to sending signals to the locking mechanism to lock or unlock the door, the controller is capable of regulating the amount of electric power supplied to the electrically powered locking mechanism. Such regulation may include increasing or decreasing the voltage and/or current to the actuator for the locking mechanism. It may include increasing or decreasing the length of time continuous or pulsed electrical power of an electrical signal is supplied to the actuator. Controller 60 may include a microprocessor 66 to effect the power regulation to the locking mechanism actuator.

Connections 62 are shown connecting the controller 60 to the actuator in lock 30 and to the temperature sensor 50 (FIG. 3). Wireless connections by conventional means may be alternatively employed.

The microprocessor 66 receives the temperature signal from the temperature detector 50, or calculates the temperature based on the COR method, and can operate the actuator of the locking mechanism, whether it is motor driven by continuous current or a pulse or solenoid driven by a solenoid-type power signal. A software or hardware switch allows the microprocessor 66 to emulate either fail safe or fail secure operation, i.e., unlock (withdraw) or lock (project) the bolt when the power is removed.

The controller 60 has an output for connection to the locking mechanism for actuating the bolts of lock 30, or the locking piece and/or bolts or latches of lock 30', for example by sending continuous electric power at a desired voltage or current level or range, or a power pulse at a desired duration and voltage or current level.

In accordance with the present invention, the temperature in the vicinity of the locking mechanism 70 on the door is determined either by a temperature sensor or calculated by electrical resistance. This temperature reading is received by the controller 60. In accordance with programming of the microprocessor 66, if the temperature in the vicinity of the locking mechanism is within a predetermined temperature range, for example, ambient temperature and a preselected range above and/or below ambient room temperature, the controller supplies a first, normal level of electric power to the actuator of the electrically powered locking mechanism to operate the latch- or deadbolt between locked and unlocked positions.

If the temperature in the vicinity of the locking mechanism as determined by the temperature sensor is outside the predetermined temperature range, for example, at or below about freezing temperature, about 32° F. (0° C.) or lower, or at some other temperature below about 40° F. (4.5° C.), the controller supplies a second, higher level of electric power to the actuator of the locking mechanism to operate the latch- or deadbolt between locked and unlocked positions. This higher level of power, which is higher than the first power level and may be a higher voltage or current, or may be a longer duration pulse, or any combination of these, will overcome any additional friction or sluggishness due to the lower temperature of the lock components.

Instead of a single higher level of power, the controller may determine a plurality or continuum of states in which the incremental increase in driving power, voltage, current or pulse may be responsive to a plurality or continuum of incremental changes in temperature. In other words, the higher level of power may vary depending on the determined temperature.

An embodiment of the controller 60 of the present invention may take the form of a hardware embodiment that uses software (including firmware, resident software, microcode, etc.). Furthermore, an embodiment may take the form of a computer program product on a tangible computer-usable storage medium having computer-usable program code embodied in the medium. A memory device or memory portion of microprocessor 66 can form the medium. Computer program code or firmware to carry out an embodiment of the present disclosure could also reside on optical or magnetic storage media, especially while being transported or stored prior to or incident to the loading of the computer program code or firmware into the microprocessor 66. This computer program code or firmware can be loaded, as an example, by connecting a computer system to the programming interface.

It should be appreciated and understood that the present invention may be embodied as systems, methods, apparatus, computer readable media, non-transitory computer readable media and/or computer program products. The present invention may take the form of an entirely hardware embodiment, an entirely software embodiment (including firmware, resident software, micro-code, etc.) or an embodiment combining software and hardware aspects that may all generally be referred to herein as a "circuit," "module," "system," or "processor" configured to practice the method(s) or system(s) of the invention. The present invention may take the form of a computer program product embodied in one or more computer readable medium(s) having computer readable program code embodied thereon.

One or more computer readable medium(s) may be utilized, alone or in combination. The computer readable medium may be a computer readable storage medium or a computer readable signal medium. A suitable computer readable storage medium may be, for example, but not limited to, an electronic, magnetic, optical, electromagnetic, infrared, or semiconductor system, apparatus, or device, or any suitable combination of the foregoing. Other examples of suitable computer readable storage medium would include, without limitation, the following: an electrical connection having one or more wires, a portable computer diskette, a hard disk, a random access memory (RAM), a read-only memory (ROM), an erasable programmable read-only memory (EPROM or flash memory), an optical fiber, a portable compact disc read-only memory (CD-ROM), an optical storage device, a magnetic storage device, or any suitable combination of the foregoing. A suitable computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Scala, Ruby, Python, Smalltalk, C++ or the like and conventional procedural programming languages, such as the "C" programming language or similar programming languages. The program code may execute entirely on the user's computing device (such as, a computer), partly on the user's computing device, as a stand-alone software package, partly on the user's computer device and partly on a remote computing device or entirely on the remote computing device or server. In the latter scenario, the remote computing device may be connected to the user's computing device through any type of network, including a local area network (LAN), a wide area network (WAN), or a wireless local area network (WLAN), or the connection may be made to an external computing device (for example, through the Internet using an Internet Service Provider).

The methods of operation of the present invention may be implemented by computer program instructions. These computer program instructions may be provided to a processor of a general purpose computing device (such as, a computer), special purpose computing device, or other programmable data processor or processing apparatus to produce a machine, such that the instructions, which execute via the processor of the computing device or other programmable data processing apparatus, create means for implementing the functions/acts specified in the flowchart and/or block diagram block or blocks.

These computer program instructions may also be stored in a computer readable medium that can direct a computing device, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computing device, other programmable data processing apparatus, or other devices to cause a series of operational steps to be performed on the computing device, other programmable apparatus or other devices to produce a computer implemented process such that the instructions which execute on the computing device or other programmable apparatus provide processes for implementing the functions/acts specified in a flowchart and/or block diagram block or blocks.

Thus, the present invention provides an improved lock that is able to function at varying temperatures, and which includes a locking mechanism that is driven to overcome performance issues due to temperature change, particularly at temperatures well below ambient, such as sub-freezing temperatures. The present invention also provides an improved method and system for controlling the operation of lock actuators and the power applied thereby to locking mechanisms, at a variety of temperatures.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of ensuring performance of a powered locking mechanism at different temperatures comprising:

providing a lock having an electrically powered locking mechanism operable between locked and unlocked positions;

providing an electric power supply for the locking mechanism;

providing a controller for operating the locking mechanism between locked and unlocked positions, the controller being capable of regulating the amount of electric power supplied to the electrically powered locking mechanism in accordance with a determined temperature in the vicinity of the locking mechanism;

determining temperature in the vicinity of the locking mechanism;

if the determined temperature in the vicinity of the locking mechanism is within a predetermined temperature range, then by way of the controller, a first level of electric power is supplied to the electrically powered locking mechanism to operate the electrically powered locking mechanism between locked and unlocked positions; and if the determined temperature in the vicinity of the locking mechanism is below the predetermined temperature range, then by way of the controller, a second level of electric power is supplied to the electrically powered locking mechanism to operate the electrically powered locking mechanism between locked and unlocked positions, the second level of electric power being higher than the first level of electric power.

2. A method of ensuring performance of a powered locking mechanism at different temperatures comprising:

providing a lock having an electrically powered locking mechanism operable between locked and unlocked positions;

providing an electric power supply for the locking mechanism;

providing a controller for operating the locking mechanism between locked and unlocked positions, the controller being capable of regulating the amount of electric power supplied to the electrically powered locking mechanism in accordance with a determined temperature in the vicinity of the locking mechanism;

determining temperature in the vicinity of the locking mechanism;

if the determined temperature in the vicinity of the locking mechanism is at room temperatures, then by way of the controller, a first level of electric power is supplied to the electrically powered locking mechanism to operate the electrically powered locking mechanism between locked and unlocked positions; and if the determined temperature in the vicinity of the locking mechanism is at sub-freezing temperatures, then by way of the controller, a second level of electric power is supplied to the electrically powered locking mechanism between locked and unlocked positions, the second level of electric power being greater than the first level of electric power.

3. The method of claim 1 wherein the electrically powered locking mechanism projects and retracts a latch- or deadbolt between locked and unlocked positions.

4. The method of claim 1 wherein the electrically powered locking mechanism moves a locking piece in and out of locking engagement with a lock hub.

5. The method of claim 1 wherein the locking mechanism is powered between locked and unlocked positions by an electric motor.

6. The method of claim 1 wherein the locking mechanism is powered between locked and unlocked positions by a solenoid.

7. The method of claim 1 wherein the electric power supplied to the locking mechanism is in the form of an electrical pulse.

8. The method of claim 1 wherein the electric power supplied to the locking mechanism is in the form of continuous electrical power.

9. The method of claim 1 wherein the second level of electric power is a different current than the current of the first level of electric power.

10. The method of claim 1 wherein the second level of electric power is a different voltage than the voltage of the first level of electric power.

11. The method of claim 1 wherein the second level of electric power is a different pulse length than the pulse length of the first level of electric power.

12. The method of claim 1 wherein the second level of electric power may be varied above the first level of electric power depending on the temperature in the vicinity of the locking mechanism.

13. The method of claim 1 further including providing a temperature sensor for determining the temperature in the vicinity of the locking mechanism.

14. The method of claim 1 further including calculating the temperature in the vicinity of the locking mechanism by measuring electrical resistance of a conductor in the lock mechanism.

15. A lock comprising:

an electrically powered locking mechanism operable between locked and unlocked positions;

an electric power supply for the locking mechanism;

a controller for operating the locking mechanism between locked and unlocked positions, the controller being capable of regulating the amount of electric power supplied to the electrically powered locking mechanism and determining temperature in the vicinity of the locking mechanism, the controller being capable of supplying first and second levels of electric power to the electrically powered locking mechanism in accordance with the temperature in the vicinity of the locking mechanism;

wherein if the determined temperature in the vicinity of the locking mechanism is within a predetermined temperature range, the controller is configured to cause a first level of electric power to be supplied to the electrically powered locking mechanism to operate the electrically powered locking mechanism between locked and unlocked positions, and if the determined temperature in the vicinity of the locking mechanism is below the predetermined temperature range, the controller is configured to cause the second level of electric power to be supplied to the electrically powered locking mechanism to operate the electrically powered locking mechanism between locked and unlocked positions, the second level of electric power being greater than the first level of electric power.

16. The lock of claim 15 wherein the electrically powered locking mechanism is selected from the group consisting of a latchbolt, a deadbolt and a locking piece.

17. The lock of claim 15 further including a temperature sensor for determining the temperature in the vicinity of the locking mechanism.

18. The lock of claim 15 wherein the controller is capable of calculating the temperature in the vicinity of the locking mechanism by measuring electrical resistance of a conductor in the lock mechanism.

19. The lock of claim 15 wherein the controller is capable of varying the second level of electric power above the first level of electric power depending on the temperature in the vicinity of the locking mechanism.

* * * * *